US011295620B2

(12) United States Patent
Kim et al.

(10) Patent No.: US 11,295,620 B2
(45) Date of Patent: Apr. 5, 2022

(54) SERVER AND CONTROLLING METHOD OF SERVER

(71) Applicant: SAMSUNG ELECTRONICS CO., LTD., Suwon-si (KR)

(72) Inventors: Woomok Kim, Suwon-si (KR); Jooyoung Kim, Suwon-si (KR); Heeju Joo, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 4 days.

(21) Appl. No.: 16/742,105

(22) Filed: Jan. 14, 2020

(65) Prior Publication Data

US 2020/0250983 A1 Aug. 6, 2020

(30) Foreign Application Priority Data

Jan. 31, 2019 (KR) ..... 10-2019-0012524

(51) Int. Cl.
*G08G 1/16* (2006.01)
*G08G 1/123* (2006.01)
*G08G 1/052* (2006.01)

(52) U.S. Cl.
CPC ..... *G08G 1/164* (2013.01); *G08G 1/052* (2013.01); *G08G 1/123* (2013.01); *G08G 1/166* (2013.01)

(58) Field of Classification Search
None
See application file for complete search history.

(56) References Cited

U.S. PATENT DOCUMENTS

| | | | | |
|---|---|---|---|---|
| 6,909,997 | B2 | 6/2005 | Chen et al. | |
| 8,352,111 | B2 | 1/2013 | Mudalige | |
| 8,948,995 | B2 | 2/2015 | Pandita et al. | |
| 9,261,882 | B2 | 2/2016 | Kim et al. | |
| 9,672,666 | B2 | 6/2017 | Shin et al. | |
| 9,852,554 | B2 | 12/2017 | Nix | |
| 10,579,072 | B2 | 3/2020 | Yang et al. | |
| 2014/0159923 | A1 | 6/2014 | Koodli et al. | |
| 2014/0279707 | A1* | 9/2014 | Joshua | G06Q 30/0283 705/400 |
| 2016/0334805 | A1 | 11/2016 | Rothoff et al. | |
| 2017/0011633 | A1 | 1/2017 | Boegel | |

(Continued)

FOREIGN PATENT DOCUMENTS

| | | |
|---|---|---|
| JP | 4525392 | 8/2010 |
| JP | 2017-132285 A | 8/2017 |

(Continued)

OTHER PUBLICATIONS

Search Report and Written Opinion dated Jun. 10, 2020 in counterpad International Patent Application No. PCT/KR2020/001147.

*Primary Examiner* — Carlos Garcia
(74) *Attorney, Agent, or Firm* — Nixon & Vanderhye P.C.

(57) ABSTRACT

A server is provided. The server includes a communicator comprising communication circuitry, a memory and a processor configured to control the server to store information on a plurality of safety components included in a plurality of vehicles received through the communicator, combine at least one safety component of the plurality of vehicles based on the information on the stored plurality of safety components, and identify surroundings of the plurality of vehicles using the combined safety components.

18 Claims, 11 Drawing Sheets

(56) References Cited

U.S. PATENT DOCUMENTS

| | | | | |
|---|---|---|---|---|
| 2017/0080952 | A1 | 3/2017 | Gupta et al. | |
| 2017/0225687 | A1 | 8/2017 | Pu | |
| 2017/0242095 | A1 | 8/2017 | Schuh et al. | |
| 2017/0264488 | A1 | 9/2017 | Ben Ami et al. | |
| 2017/0369062 | A1 | 12/2017 | Saigusa et al. | |
| 2018/0120112 | A1 | 5/2018 | Yost | |
| 2018/0288569 | A1* | 10/2018 | Wang | H04W 4/025 |
| 2019/0025819 | A1* | 1/2019 | Ferguson | G05D 1/0027 |
| 2019/0213881 | A1* | 7/2019 | Bender | B60W 50/14 |

FOREIGN PATENT DOCUMENTS

| | | | |
|---|---|---|---|
| KR | 10-1454824 | | 11/2014 |
| KR | 10-1621877 | | 5/2016 |
| KR | 10-2017-0101874 | | 9/2017 |
| KR | 10-2018-0013667 | | 2/2018 |
| KR | 10-1920131 | B1 | 11/2018 |
| KR | 10-1973626 | B1 | 4/2019 |
| WO | WO 2015/127056 | A2 | 8/2015 |

* cited by examiner

FIG. 4

| | | (1) TRUCK | (2) PASSENGER CAR | (3) SUV |
|---|---|---|---|---|
| MANUFACTURER | | AAA | BBB | CCC |
| YEAR/MODEL | | PORTER / 2013 | E220d / 2018 | X6 / 2014 |
| SAFETY COMPONENT | FRONT | HD BLACK BOX (VALID VISIBILITY 5M/ DAY TIME) | FHD CAMERA (VALID VISIBILITY 15M/ DAY TIME) | 4K CAMERA (VALID VISIBILITY 20M/ DAY TIME) |
| | REAR | 4CH ULTRASONIC SENSOR (3.5m) | FHD CAMERA (VALID VISIBILITY 15M/ DAY TIME) | - |
| | LONG DISTANCE | - | 2ch RADAR (35M AHEAD/DAY TIME, RECOGNITION RATE 60%) | 16ch LIDAR (FOUR DIRECTIONS 20M/ DAY TIME, RECOGNITION RATE 95%) |
| | LEFT | 2CH ULTRASONIC SENSOR (3m) | - | - |
| | RIGHT | 2CH ULTRASONIC SENSOR (3m) | - | - |
| | AUTONOMOUS COMPONENT | - | Cruise Control | Adaptive Cruise Control |
| | | - | Auto Lane Change | Collision Warning |
| | | - | - | |
| | COMMUNICATION | OBD / Mobile Phone | OBD / Mobile Phone | OBD / IVI |

FIG. 7

| | | (1) TRUCK | (2) PASSENGER CAR | (3) SUV | (4) Express Bus |
|---|---|---|---|---|---|
| MANUFACTURER | | AAA | BBB | CCC | DDD |
| YEAR/MODEL | | PORTER / 2013 | E220d / 2018 | X6 / 2014 | BX212 / 2016 |
| SAFETY COMPONENT | FRONT | HD BLACK BOX (VALID VISIBILITY 5M/ DAY TIME) | FHD CAMERA (VALID VISIBILITY 15M/ DAY TIME) | 4K CAMERA (VALID VISIBILITY 20M/ DAY TIME) | HD CAMERA (VALID VISIBILITY 8M/ DAY TIME) |
| | REAR | 4CH ULTRASONIC SENSOR (3.5m) | P FHD CAMERA (VALID VISIBILITY 15M/ DAY TIME) | - | S 8CH ULTRASONIC SENSOR (4.5m) |
| | LONG DISTANCE | - | 2ch RADAR (35M AHEAD/DAY TIME, RECOGNITION RATE 60%) | 16ch LIDAR (FOUR DIRECTIONS 20M/ DAY TIME, RECOGNITION RATE 95%) | 8ch RADAR (AHEAD) |
| | LEFT | − 2CH ULTRASONIC SENSOR (3m) | - | - | + 4CH ULTRASONIC SENSOR (4.5m) |
| | RIGHT | 2CH ULTRASONIC SENSOR (3m) | - | - | - |
| | AUTONOMOUS COMPONENT | - | Cruise Control | Adaptive Cruise Control | Cruise Control |
| | | - | Auto Lane Change | Collision Warning | Emergency Brake |
| | | - | - | | |
| | COMMUNICATION | OBD / Mobile Phone | OBD / Mobile Phone | OBD / IVI | OBD / IVI |

P PRIMARY SAFEY COMPONENT S SECONDARY SAFEY COMPONENT

+/- ADD/DELETE SAFETY COMPONENTS

SERVER AND CONTROLLING METHOD OF SERVER

CROSS-REFERENCE TO RELATED APPLICATION

This application is based on and claims priority under 35 U.S.C. § 119 to Korean Patent Application No. 10-2019-0012524, filed on Jan. 31, 2019, in the Korean Intellectual Property Office, the disclosure of which is incorporated by reference herein in its entirety.

BACKGROUND

1. Field

The disclosure relates to a server and a control method thereof and for example, to a server for combining safety components included in a plurality of automobiles to improve safety of the automobiles and a control method thereof.

2. Description of Related Art

A vehicle is an apparatus which drives wheels and transports a person, cargo, etc. from one place to another place. In order to increase safety and convenience for a user using a vehicle, technology development for incorporating various sensors, electronic apparatuses, and the like into the vehicle is speeding up.

In particular, a concept of platooning has been proposed as a related art regarding vehicles. The platooning may refer to a plurality of vehicles travelling on a road while sharing driving information with each other and considering external environment.

Since safety information between vehicles or danger information of the road conditions were only shared by providing a warning sound, there was a problem in that the user had to deal with unexpected situation instantly. Accordingly, there is a need for a technology allowing a user to be aware unexpected situations to move safely to a destination.

SUMMARY

Embodiments of the disclosure provide a server that combines safety components included in a plurality of vehicles, thereby improving a safe distance of the vehicles, and a control method thereof.

An example aspect of the disclosure relates to a server including a communicator comprising communication circuitry, a memory and a processor configured to control the server to: store information on a plurality of safety components included in a plurality of vehicles, respectively, received through the communicator, combine at least one safety component of the plurality of vehicles, respectively, based on the information on the stored plurality of safety components, and identify surroundings of the plurality of vehicles using the combined safety components.

The processor may be configured to combine safety components having the best performance by function among the plurality of safety components included in the plurality of vehicles, respectively.

The processor may be configured to identify arrangement positions of the plurality of vehicles based on the functions of the combined safety components.

The plurality of vehicles may at least partially coincide with each other on an entire driving path based on a departure point, a destination, a waypoint and a departure time.

The processor may be configured to control the server to further obtain a driving speed based on at least one of the departure point, the destination, the waypoint and the departure time, and transmit a driving control command generated based on the entire driving path and the obtained driving speed to at least one autonomous driving vehicle among the plurality of vehicles through the communicator.

The processor may be configured to control the server to further obtain the driving speed based on at least one of the departure point, the destination, the waypoint and the departure time, and transmit a notification corresponding to the driving control command generated based on the entire driving path and the obtained driving speed to a user terminal corresponding to at least one of the plurality of vehicles through the communicator.

The processor may be configured to, based on at least one among the plurality of vehicles being deleted or a new vehicle being added, control the server to recombine safety components in consideration of the at least one deleted vehicle or a safety component of the new vehicle.

The processor may be configured to, based on a vehicle including safety component having higher performance than the combined safety components being searched around the plurality of vehicles while the plurality of vehicles are traveling, control the server to recombine safety components by including the safety component having higher performance of the searched vehicle.

The processor may be configured to, based on the other group of vehicles existing around the plurality of vehicles while the plurality of vehicles are traveling, control the server to recombine the safety components using the combined safety components and the combined safety components of the other group of vehicles.

The plurality of vehicles may be pre-authenticated by users of each vehicle.

Another example aspect of the disclosure relates to a controlling method of a server including: receiving information on a plurality of safety components included in each of a plurality of vehicles, storing information on the received plurality of safety components based on the information on the stored plurality of safety components, combining at least one safety component of the plurality of vehicles, respectively, and identifying surroundings of the plurality of vehicles using the combined safety components.

The combining may include combining safety components having the best performance by function among the plurality of safety components included in the plurality of vehicles, respectively.

The method may further include identifying arrangement positions of the plurality of vehicles based on functions of the combined safety components.

The plurality of vehicles may at least partially coincide with each other on an entire driving path based on at least one of a departure point, a destination, a waypoint and a departure time.

The method may further include obtaining a driving speed based on at least one of the departure point, the destination, the waypoint and the departure time, and transmitting a driving control command generated based on the entire driving path and the obtained driving speed to at least one autonomous driving vehicle among the plurality of vehicles.

The method may further include obtaining a driving speed based on at least one of the departure point, the destination, the waypoint and the departure time, and transmitting a notification corresponding to a driving control command generated based on the entire driving path and the obtained driving speed to a user terminal corresponding to at least one of the plurality of vehicles.

The method may further include, based on at least one among the plurality of vehicles being deleted or a new vehicle being added, recombining safety components in consideration of the deleted at least one vehicle or safety components of the new vehicle.

The method may further include, based on a vehicle including a safety component having higher performance than the combined safety components being searched around the plurality of vehicles while the plurality of vehicles are traveling, recombining the safety components including the safety components having higher performance.

The method may further include, based on the other group of vehicles existing around the plurality of vehicles while the plurality of vehicles are traveling, recombining the safety components using the combined safety components and the combined safety components of the other group of vehicles.

Another example aspect of the disclosure relates to a non-transitory computer readable recording medium including a program for executing a controlling method of a server, wherein the controlling method of the server includes storing information on a plurality of safety components included in each of plurality of vehicles received, combining at least one safety component of the plurality of vehicles, respectively, based on the information on the stored plurality of safety components, and identifying surroundings of the plurality of vehicles using the combined safety components.

BRIEF DESCRIPTION OF THE DRAWINGS

The above and other aspects, features and advantages of certain embodiments of the present disclosure will be more apparent from the following detailed description, taken in conjunction with the accompanying drawings, in which:

FIGS. 4, 5A and 5B are diagrams illustrating an example combination of safety components of a plurality of vehicles according to an embodiment;

FIGS. 6 and 7 are diagrams illustrating an example combination of dynamic safety components according to an embodiment;

DETAILED DESCRIPTION

Figure 1:
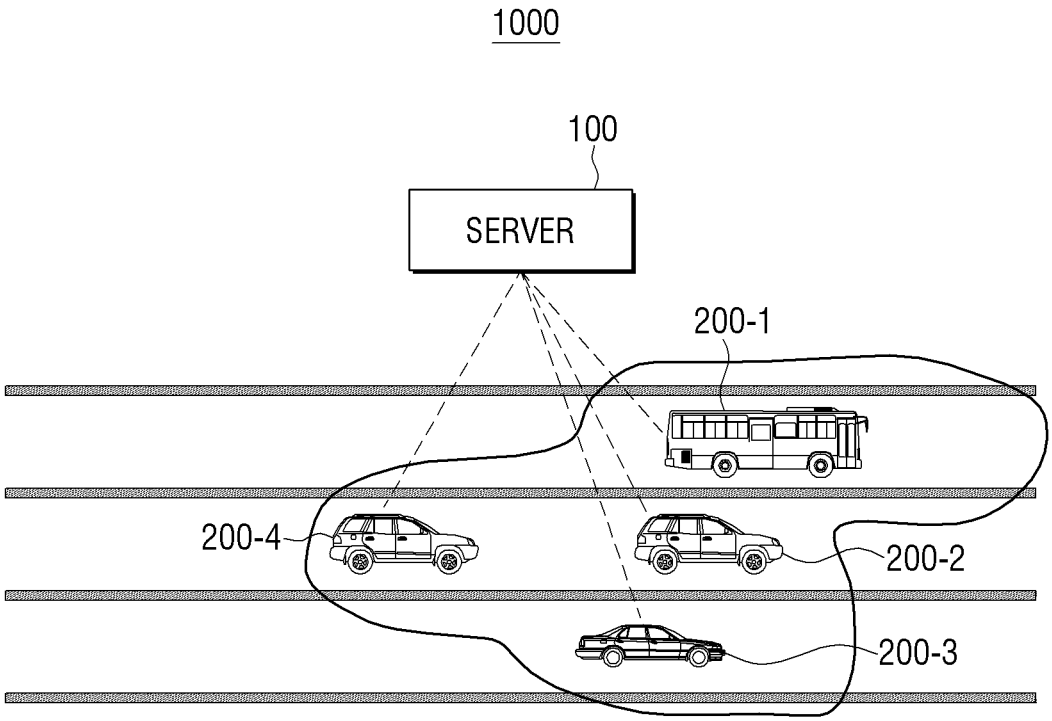
FIG. 1 is a diagram illustrating an example control system of a server according to an embodiment.

The terms used to describe the various example embodiments will be briefly explained, and the various example embodiments will be described in greater detail below with reference to the accompanying drawings.

Terms used in the present disclosure are selected as general terminologies currently widely used in consideration of the configuration and functions of the present disclosure, but can be different depending on intention of those skilled in the art, a precedent, appearance of new technologies, and the like. Further, in certain cases, terms may be arbitrarily selected. In this case, the meaning of the terms will be described in the description of the corresponding embodiments. Accordingly, the terms used in the description should not necessarily be understood as simple names of the terms, but may be defined based on meanings of the terms and overall contents of the present disclosure.

The example embodiments may vary, and may be provided in different example embodiments. Various example embodiments will be described with reference to accompanying drawings. However, this is not intended to limit the scope to an example embodiment, and therefore, it should be understood that all the modifications, equivalents or substitutes included under the spirit and technical scope of the disclosure are encompassed. While describing various example embodiments, if it is identified that the specific description regarding a known technology obscures the gist of the disclosure, the specific description may be omitted.

The terms such as "first," "second," and so on may be used to describe a variety of elements, but the elements should not be limited by these terms. The terms used herein are solely intended to explain specific example embodiments, and not to limit the scope of the present disclosure.

Singular forms are intended to include plural forms unless the context clearly indicates otherwise. The terms "include", "comprise", "is configured to," etc., of the description are used to indicate that there are features, numbers, steps, operations, elements, parts or combination thereof, and they should not exclude the possibilities of combination or addition of one or more features, numbers, steps, operations, elements, parts or a combination thereof.

In an example embodiment, 'a module' or 'a unit' performs at least one function or operation, and may be realized as hardware (e.g., circuitry), firmware, software, or combination thereof. In addition, a plurality of 'modules' or 'units' may be integrated into at least one module and may be realized as at least one processor in an integrated manner except for 'modules' or 'units' that should be realized in specific hardware.

The example embodiments of the disclosure will be described in greater detail below in a manner that will be understood by one of ordinary skill in the art. However, example embodiments may be realized in a variety of different configurations, and not limited to descriptions provided herein. Also, well-known functions or constructions may not be described in detail where they would obscure the disclosure with unnecessary detail.

Hereinafter, various example embodiments will be described in greater detail with reference to accompanying drawings.

FIG. 1 is a diagram illustrating an example control system of a server according to an embodiment.

Referring to FIG. 1, a control system 1000 of a server includes a server 100 and a plurality of vehicles 200-1, 200-2, 200-3, 200-4 (which may be collectively referred to hereinafter as 200-1 to 200-4).

The server 100 may perform communication with the plurality of vehicles 200-1 to 200-4. The plurality of vehicles 200-1 to 200-4 may be two or more vehicles selected based on driving planning information among a plurality of vehicles in which information thereof is stored in the server 100. The information of the plurality of vehicles stored in the server 100 may be based on a user input. For example, the user may execute an application accessible to the server 100 through a terminal device or a UI of a vehicle, and register information of the vehicle through authentication.

Safety component information for each vehicle may be input by the user, but it may be information previously input by a vehicle manufacturer when the user enters a product name of the vehicle. The safety component information may be information additional input by the user to information input by the vehicle manufacturer.

As described above, since the vehicle information is registered through the authentication of the user and the user requests a grouping of the vehicle after logging in, security of the information may be ensured.

Hereinafter, two or more vehicles selected by driving planning information may be referred to as a 'group of vehicles' for convenience of description. Meanwhile, a 'vehicle cluster' may refer, for example, to the 'group of vehicles'. Meanwhile, although only an SUV, a passenger car and a bus are shown in FIG. 1, vehicles applicable to the disclosure may include, for example, and without limitation, various types of vehicles, such as a truck and a two-wheeled vehicle, or the like.

The server 100 may combine at least one safety component of the plurality of vehicles 200-1 to 200-4 based on information on safety components provided in the plurality of vehicles 200-1 to 200-4, respectively. The safety component may refer, for example, to a part or a program for implementing a safety function of the vehicle. For example, the safety component may include all kinds of vehicle components that a vehicle senses itself or is involved in receiving information to implement the safety function of the vehicle. The safety function may refer, for example, to the user's safety, especially may refer to avoiding a physical risk of the user while driving the vehicle. The safety function may be implemented by various sensors provided in the vehicle. For example, the safety function may include assuring a safe distance in the front, rear and side, remote sensing, speed during autonomous driving, control function of direction, or the like, but is not limited thereto.

As an example embodiment, the safety component may include, for example, and without limitation, an ultrasonic sensor, front and rear camera, a 3D camera, RADAR, LIDAR, a cruise control, an adaptive cruise control, advanced smart cruise control, around view, or the like.

For example, the server 100 may combine a safety component in a way of selecting a safety component which has the best performance among the plurality of vehicles 200-1 to 200-4 for each safety function.

In addition, the server 100 may identify surrounding environment of the plurality of vehicles 200-1 to 200-4 based on a value sensed by the safety component of the plurality of vehicles 200-1 to 200-4. In addition, the server 100 may transmit information notifications, warnings, driving commands, and the like to the plurality of vehicles 200-1 to 200-4 based on a identified surrounding environment.

Specific identifying operation of the server 100 will be described in greater detail below with reference to FIGS. 2 to 11.

Figure 2:
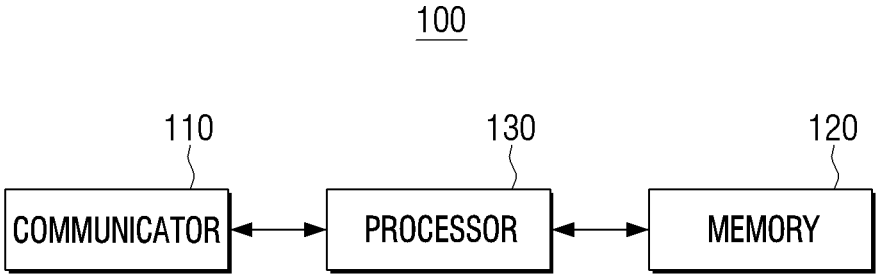
FIG. 2 is a block diagram illustrating an example configuration of a server according to an embodiment.

FIG. 2 is a block diagram illustrating an example configuration of a server according to an embodiment.

Referring to FIG. 2, a server 100 includes a communicator (e.g., including communication circuitry) 110, a memory 120 and a processor (e.g., including processing circuitry) 130.

The communicator 110 may include various communication circuitry and may communicate with various external devices according to various types of communication methods. The server 100 may communicate with the plurality of vehicles and user terminal devices corresponding to the plurality of vehicles, respectively, through the communicator 110.

The communicator 110 connected to an external device may include communicating through a third device (e.g., a repeater, a hub, an access point, a server, a gateway or the like). The wireless communication, for example, may include a cellular communication using at least one among long-term evolution (LTE), LTE Advance (LTE-A), code division multiple access (CDMA), wideband CDMA (WCDMA), universal mobile telecommunications system (UMTS), Wireless Broadband (WiBro), and global system for mobile communications (GSM), or the like. According to an embodiment, the wireless communication may include at least one of, for example, wireless fidelity (Wi-Fi), Bluetooth, Bluetooth low power (BLE), Zigbee, near field communication (NFC), magnetic secure transmission, radio frequency (RF), or a body area network (BAN). Wired communication may include at least one of, for example, universal serial bus (USB), high definition multimedia interface (HDMI), recommended standard 232 (RS-232), power line communication, plain old telephone service (POTS), and the like. A network in which wireless or wired communication is performed may include at least one of a telecommunication network, for example, a computer network (e.g., LAN or WAN), the Internet, or a telephone network.

The memory 120 may store various programs or data necessary for the operation of the server 100. For example, the memory 120 may store at least one command. The processor 130 may perform the operation described above by executing the command stored in the memory 120. The memory 120 may be implemented as a nonvolatile memory, a volatile memory, a flash-memory, a hard disk drive (HDD), or a solid state drive (SSD) or the like.

For example, the memory 120 may store information regarding the plurality of vehicles from the outside. The information on the plurality of vehicles may include information on the safety components of each vehicle. In addition, since external may refer, for example, to an external device distinguished from the server 100, it may include a user terminal device, a vehicle, the other server, or the like.

In addition, the memory 120 may store a trained artificial intelligence model. The trained artificial intelligence model may be trained to secure the best safety and safe distance by combining safety components of various vehicles.

The artificial intelligence model may be, for example, a model based on a neural network. The artificial intelligence model may be designed to simulate a human brain structure on a computer and include a plurality of weighted network nodes that simulate neurons in a human neural network. The plurality of network nodes may form a connection relationship so that neurons simulate a synaptic activity of neurons that sends and receives signals through synapses. In addition, the artificial intelligence model may include, for example, a neural model or a deep learning model developed from a neural network. The plurality of network nodes of the deep learning model may be located at different depths (or layers) and exchange data according to a convolutional connection relationship. For example, the artificial intelligence model may include, for example, and without limitation, a deep neural network (DNN), a recurrent neural network (RNN), a bidirectional recurrent deep neural network (BRDNN), or the like, but are not limited thereto.

A processor 130 may include various processing circuitry and control an overall operation of the server 100.

According to an embodiment, the processor 130 may, for example, and without limitation, be implemented as a digital signal processor (DSP), a microprocessor, a time controller (TCON), or the like, but is not limited thereto, and may include, for example, and without limitation, one or more among a central processing unit (CPU), a micro controller unit (MCU), a micro processing unit (MPU), a controller, an application processor (AP), or a communication processor (CP), an ARM processor, or the like, or may be expressed as a corresponding term. In addition, the processor 130 may be implemented as a system on chip (SoC) including a processing algorithm and a large scale integration (LSI), or may be implemented in the form of a field programmable gate array (FPGA).

For example, the processor 130 may receive information on the plurality of safety components included in the plurality of vehicles, respectively, through the communicator 110. The information on the plurality of safety components may be received from the plurality of vehicles or user terminal devices corresponding to the plurality of vehicles. For example, the information on the plurality of safety components may be received from the user terminal device as input when the user creates an account to use a service provided by the server 100.

According to another embodiment, information on the plurality of vehicles may be transmitted to the server 100 from the user's vehicle when the user requests the server 100 to provide a service. The user may perform user authentication when creating an account, and information may be information of the vehicle input when the account is created or information of the vehicle input through login later on. For example, information on the plurality of vehicles stored in the server 100 may be previously authenticated by the user of each car.

In addition, the processor 130 may combine at least one safety component of the plurality of vehicles, respectively, based on the information on the plurality of safety components included in the plurality of vehicles, respectively. For example, the processor 130 may combine safety components having the best performance for each function among the plurality of safety components included in the plurality of vehicles, respectively. The processor 130 may create the group of vehicles through the combination of the safety components. The processor 130 may combine the safety components using the trained artificial intelligence model stored in the memory 120. A training for the artificial intelligence model according to the disclosure will be described in greater detail below with reference to FIG. 3. An embodiment that combines the safety components of the plurality of vehicles will be described in greater detail below with reference to FIGS. 4 to 8.

The plurality of vehicles may at least partially coincide with each other based on at least one of a starting point, a destination, a waypoint and a departure time. For example, the processor 130 may perform grouping by selecting two or more vehicles that driving sections partially coincide on the entire driving path of each vehicle based on the starting point, the destination, the waypoint and the departure time, which may, for example, be input by the user.

The vehicles included in the group may vary depending on the driving section, time or the like. For example, a new vehicle may be added to the group or at least one of the existing vehicles may be deleted based on a driving path of each vehicle.

As described above, when at least one of the plurality of vehicles is deleted or a new vehicle is added, the processor 130 may recombine the safety components. For example, when at least one of the plurality of vehicles is deleted, the processor 130 may recombine the safety components included in the vehicle except for the deleted vehicle among the plurality of vehicles. When the new vehicle is added to the group of vehicles, the processor 130 may further consider the safety components of the newly added vehicle and recombine the safety components to secure an optimal safety and safe distance. An embodiment in which a vehicle is added or deleted to the group of vehicles will be described in greater detail below with reference to FIGS. 6 and 7.

When a vehicle including a safety component having higher performance compared to the safety components combined around the group of vehicles is searched while the plurality of vehicles included in the group of vehicles are traveling, the processor 130 may recombine the safety components by including the high-performance safety components of the searched vehicle. The searched vehicle may be a vehicle previously authenticated by the user.

For example, the processor 130 may identify the safety function which can be implemented by a combination of safety components of another vehicle searched, and may combine the safety components so that the corresponding safety function is implemented with optimal performance.

For example, when a driving path is partially matched and the safety component has excellent performance, a vehicle not included in the group of vehicles is searched, while generating the group of vehicles, since driving information is not input, the processor 130 may include the searched vehicle in the group of vehicles. The searched vehicle may be driving with the group of vehicles within a predetermined distance. In addition, the processor 130 may include the high-performance safety components of the searched vehicle and recombine the safety components. The processor 130 may readjust a placement of the plurality of vehicles in the group of vehicles based on the recombined safety components.

When there are the other group of vehicles around the group of vehicles while the plurality of vehicles included in the group of vehicles are driving, the processor 130 may further consider the safety components of the vehicles included in the other group of vehicles and recombine the safety components. For example, the processor may consider all safety components of the other group of vehicles, but may recombine the safety components by further considering the combined safety components of the other group of vehicles. The processor 130 may consider the combined safety components of the present group of vehicles and the combined safety components of the other group of vehicles, and may recombine the safety components to enhance safety and safe distance. In addition, the processor 130 may change arrangement positions of the vehicle included in the group of vehicles and the vehicle included in the other group of vehicles based on the recombined safety components. An embodiment of interworking between the two vehicle groups will be described in greater detail below with reference to FIG. 10.

The processor 130 may identify surroundings of the plurality of vehicles using the safety components combined in the method described above. For example, the processor may perform functions of the combined safety components respectively and identify the surroundings of the plurality of vehicles based on the obtained result. Accordingly, each vehicle may have the same or similar effect as using a better safety component of the other vehicle, thereby improving the safety and safe distance of each vehicle.

The processor 130 may identify the arrangement positions of the plurality of vehicles based on the function of the combined safety components. For example, a vehicle including a safety component having the best performance among safety components for securing front safe distances of the plurality of vehicles may be placed in front of the group of vehicles. A vehicle including a safety component having the best performance among the safety components for securing rear safe distances of the plurality of vehicles may be placed at the rear of the group of vehicles.

When one of the plurality of vehicles includes the best safety component with respect to various safety functions, the processor 130 may select a plurality of safety components having the best performance in one vehicle and combine them with a safety component of the other vehicle. When the safety function is unable to be simultaneously selected in one vehicle, the processor 130 may assign a priority for each safety function, and may be selected as a safety component for a function having a high priority.

For example, assuming that securing the front safe distance is prioritized to securing the rear safe distance and two functions cannot be selected from the same vehicle in the group of vehicles, if both a performance of a safety component for securing a front safe distance of a first vehicle and a performance of a safety component for securing a rear safe distance of a first vehicle have the best performance, the processor 130 may select the safety component for securing the front safe distance of the first vehicle and the safety component for securing the rear safe distance of a second vehicle having the best performance among the plurality of vehicles other than the selected vehicles. In this case, the first vehicle may be placed at the front, and the second vehicle may be placed at the rear within the group of vehicles.

The processor 130 may transmit a driving control command to at least one vehicle among the group of vehicles through the communicator 110. For example, the processor 130 may acquire an entire driving path and driving speed of each vehicle based on the driving planning information input by the user. The driving planning information may include at least one of a departure point, a destination, a waypoint, and a departure time. In addition, the processor 130 may receive road and traffic conditions and the like from an external server through the communicator 110 and further reflect the received information to calculate the entire driving path and driving speed of each vehicle.

The processor 130 may transmit the driving control command generated based on the acquired entire driving path and driving speed of each vehicle to at least one vehicle. When at least one autonomous vehicle is included in the group of vehicles, the processor 130 may transmit the driving control command to the autonomous driving vehicle through the communicator 110.

In addition, the processor 130 may transmit a notification corresponding to the driving control command to a vehicle which is not an autonomous driving vehicle. For example, the processor 130 may provide a notification corresponding to the driving control command to a navigation included in the vehicle rather than the autonomous driving vehicle or a user terminal corresponding to the vehicle. The notification may, for example, be provided in the form of a UI screen or in the form of a voice through a speaker. The notification may be transmitted to the autonomous driving vehicle. An embodiment of the UI screen related to a notification provided by the server 100 will be described in greater detail below with reference to FIG. 9.

According to various embodiments of the disclosure, in addition to the safety component of the vehicle, it is possible to further secure an improved safety and safe distance using the safety component of another vehicle.

Figure 3:
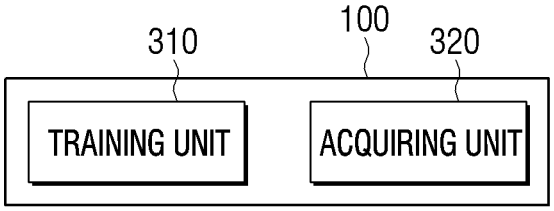
FIG. 3 is a block diagram illustrating an example operation of a server using an example artificial intelligence model according to an embodiment.

FIG. 3 is a block diagram illustrating an example operation of a server using an artificial intelligence model according to an embodiment.

Referring to FIG. 3, the server 100 may include at least one of training unit (e.g., including processing circuitry and/or executable program elements) 310 and acquiring unit (e.g. including processing circuitry and/or executable program elements) 320. The training unit 310 and the acquiring unit 320 of FIG. 3 may be implemented as a software configuration stored in the memory 120 of the server 100, but it is merely an embodiment and implemented as a separate hardware chip.

The training unit 310 may include various processing circuitry and/or executable program elements and generate or train an artificial intelligence model to acquire a combination of safety components having the maximum safety or safe distance using training data. The training unit 310 may generate a trained model having acquisition standards using the acquired trained data. For example, the training unit 310 may generate, train or update an artificial intelligence model for acquiring information related to the combination of the safety components having the maximum safety and safe distance using the safety components included in the plurality of vehicles and information on the safety and safe distance acquired by the corresponding safety components as training data.

The acquiring unit 320 may include various processing circuitry and/or executable program elements and use a predetermined data as input data of the trained model to obtain various information. For example, the acquiring unit 320 may acquire (or estimate or infer) information related to the combination having the maximum safety or safe distance using information on the plurality of safety components included in the plurality of vehicles.

A least a part of the training unit 310 and at least a part of the acquiring unit 320 may be implemented as a software module or manufactured in the form of at least one hardware chip to be mounted on the electronic apparatus. For example, at least one of the training unit 310 and the acquiring unit 320 may, for example, and without limitation, be manufactured in the form of a dedicated hardware chip for artificial intelligence (AI), as an existing general-purpose processor (e.g., a CPU or an application processor), a graphics dedicated processor (e.g., a GPU), or the like, to be mounted on the aforementioned various electronic apparatuses. The hardware chip dedicated for the artificial intelligence is a dedicated processor specialized for calculating possibility, and has higher parallelism performance than the existing general-purpose processor, so that it may process computational tasks in the field of artificial intelligence such as machine training. When the training unit 310 and the acquiring unit 320 are implemented as a software module (or a program module including an instruction), the software module may be stored in a non-transitory computer readable media. In this case, the software module may be provided by an operating system (OS) or by a predetermined application. Some of the software module may be provided by the operating system (OS) and the other may be provided by the predetermined application.

In this case, the training unit 310 and the acquiring unit 320 may be mounted on one electronic apparatus or may be mounted on separate electronic apparatuses. For example, one of the training unit 310 and the acquiring unit 320 may be included in the server 100, and the other may be included in an external server. In addition, the training unit 310 and the acquiring unit 320 may provide model information built by the training unit 310 to the acquiring unit 320 through a wired or wireless connection, or data input by the training unit 310 may be provided to the training unit 310 as additional training data.

Figure 5A:
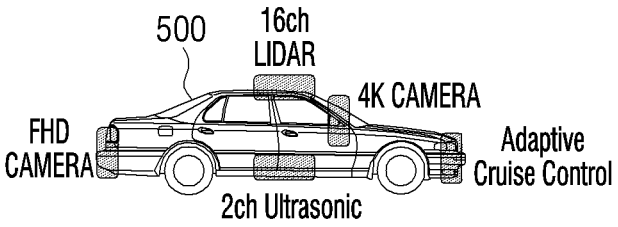
Figure 5B:
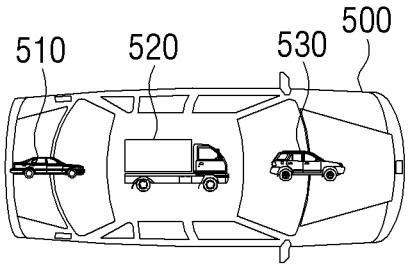

FIGS. 4, 5A and 5B are diagrams illustrating an example combination of safety components of a plurality of vehicles according to an embodiment.

Referring to FIG. 4, the server may generate a group of vehicles with two or more selected vehicles based on driving planning information input by each user among a plurality of stored vehicles. For example, a vehicle included in the generated group of vehicles may be (1) a truck, (2) a passenger car, and (3) an SUV. At this time, the server may combine the safety components of each vehicle included in the group of vehicles. For example, the server may combine a safety component having the best performance among the safety components for each function of each vehicle. The best performance may refer, for example, to securing a high safety or safe distance.

For example, the safety component for securing a front safe distance of the server may select a 4K camera of the longest SUV with a 20 m effective field of view. In addition, the safety component for securing a rear safe distance of the server may allow users to check a rear area while using a rear 4-channel ultrasonic sensor of a truck and a rear FHD camera of a passenger car, and may select a rear FHD camera of the passenger car having a large sensing range.

In addition, as for a safety component for sensing a long distance, the server may recognize all directions among 2-channel RADAR of a passenger car and 16-channel LIDAR of an SUV, and select the 16-channel LIDAR of the SUV having a high recognition rate.

As described above, the server may compare performances of the safety components provided in each vehicle by function to combine the best safety components, and the 2-channel ultrasonic sensor for securing the left and right safety distances and autonomous components may select the SUV's adaptive cruise control and the passenger car's auto lane change that can secure a higher safety than thereof. The combination of the safety components of FIG. 4 is only an example, various numbers and types of vehicles may be included in the group of vehicles while implementing in practice, and combinations of different safety components may be derived according to the included vehicles.

According to the combination of the safety components described in FIG. 4, a virtual vehicle (500 in FIGS. 5A and 5B) may be generated as described in FIGS. 5A and 5B. The virtual vehicle 500 may refer, for example, to a logical vehicle reconstituted with the safety components of the plurality of vehicles included in the group of vehicles. For example, as described in FIG. 5A, a 4K camera as a safety component for securing a front safe distance, a FHD camera as a safety component for securing a rear safe distance, a 16 channel LIDAR as a safety component for remote sensing, a 2-channel ultrasonic sensor as a safety component for securing left and right safe distances, and a virtual vehicle 500 having an adaptive cruise control as an automation component may be generated.

The virtual vehicle 500 may include a plurality of vehicles 510, 520 and 530 placed according to the combination of the safety component. For example, as shown in FIG. 5B, an SUV 530 having a 4K camera selected as a safety component for securing a front safe distance may be placed at the front of the virtual vehicle 500. In addition, a passenger car 510 having the FHD camera selected as the safety component for securing a rear safe distance may be placed at the rear of the virtual vehicle 500.

Arrangement of the vehicles illustrated in FIG. 5B is only an example, and the SUV 530 having the 16-channel LIDAR, which is a safety component for remote sensing, may be placed in the center of the virtual vehicle 500. The arrangement of the plurality of vehicles may vary depending on an importance of a predetermined function.

Figure 6:
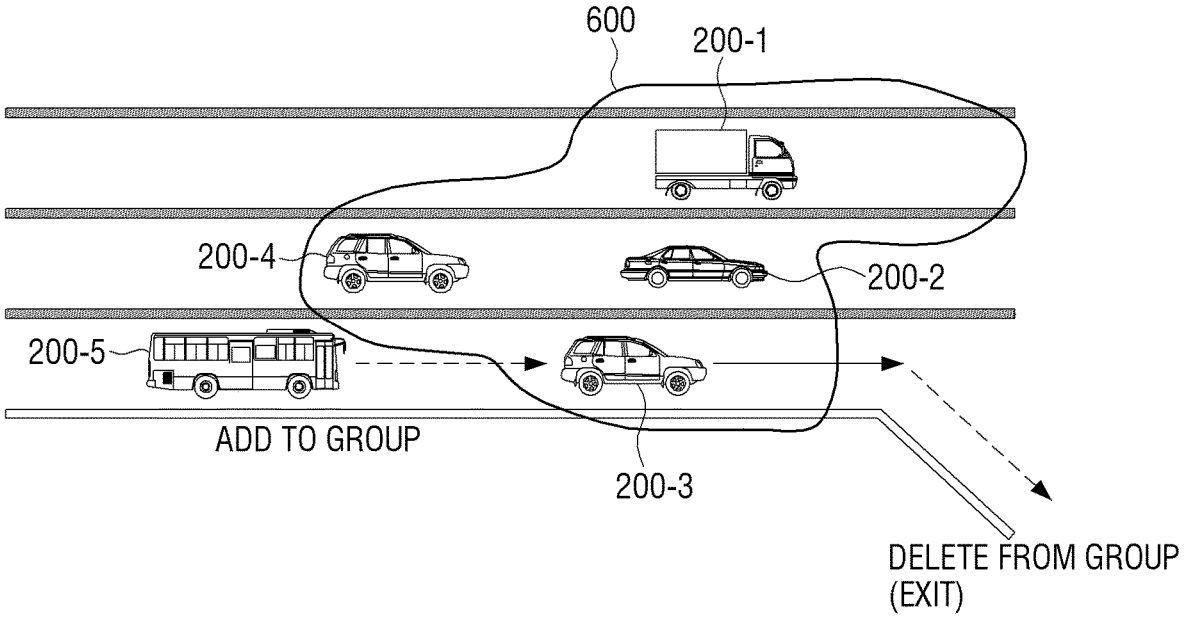

FIGS. 6 and 7 are diagrams illustrating an example combination of dynamic safety components according to an embodiment.

Referring to FIG. 6, a group of vehicles 600 may include a truck 200-1, a passenger car 200-2, a first SUV 200-3, and a second SUV 200-4. The vehicles included in the group of vehicles 600 may be vehicles in which at least some of the driving paths match based on the driving planning information input by each user.

In this case, the first SUV 200-3 among the vehicles included in the group of vehicles 600 may be deleted based on the driving path. A bus 200-5, which is a new vehicle, may be added to the group of vehicles 600 based on the driving path. At this time, the newly added vehicle may be planned to join the group of vehicles 600 later due to a different starting point based on the driving planning information, or although the driving planning information is not input, may be a vehicle, searched around the group of vehicle 6000, having a better safety component while the group of vehicles 600 is driving. In this case, the searched vehicle may be previously authenticated by the user.

As described above, a vehicle included in the group of vehicles may be changed, and the server may recombine the safety component in real time whenever the vehicle included in the group of vehicles changes.

For example, as described in FIG. 7, as an express bus (4) is added to the group of vehicles, the server may recombine the safety components. For example, since the 4-channel ultrasonic sensor of the added bus performs better than the 2 channel ultrasonic sensor of the truck, which is a safety component for securing the left safety distance, in the combination of the existing safety components, the server may change the safety component for securing the left safety distance to the 4-channel ultrasonic sensor of the bus. Thus, the truck's 2-channel ultrasonic sensor may be deleted from the combination of safety components, and the bus's 4-channel ultrasonic sensor may be added.

When a primary safety component for a plurality of safety functions is the safety components of the same vehicle, a combination of the primary safety component for the safety function may be made, and when positions of the vehicles are placed based on the combination, sufficient performance for at least one safety function may not be implemented. For this operation, the server may identify a secondary safety component for each of the safety function in advance.

For example, when both a primary safety component for securing the front safe distance and a primary safety component for securing the rear safe distance are the safety components of the first vehicle, when the first vehicle is placed in the very front of the group of vehicles, an optimal function for securing the front safe distance may be implemented, but may not be sufficiently implemented for securing the rear safe distance.

The server may identify suboptimal safety components for each safety function in advance. In addition, the server may select the safety component of the first vehicle, which is a primary safety component for securing the front safe distance, which is more important safety function, according to the importance, and when a primary safety component for securing the rear safety distance, which has a relatively low safety function, is not implemented, the server may select a safety component of the second vehicle, which is a suboptimal safety component.

As described in FIG. 7, the server may select the FHD camera of the passenger car for and an 8-channel ultrasonic sensor of the bus as the safety component for securing the rear safety distance, and identify an FHD camera having a better performance as the primary safety component, and the 8-channel ultrasonic sensor as the secondary safety component.

In addition, the server may combine the selected safety components and place the plurality of vehicles based on the combined safety components. For example, the server may place the first vehicle at the very front of the group of vehicles and the second vehicle at the very end of the group of vehicles.

As the vehicles are placed in consideration of important safety functions first, when securing the safety distance is insufficient as the primary safety component for the less important safety function, an improved safety may be secured using the secondary safety component.

According to an embodiment, the server may select the plurality of safety components for a safety function with high importance. This may improve stability by sensing more information about the safety function with high importance. For example, the server may select both the FHD camera and the ultrasonic sensor as safety components for a function of securing the front safe distance, which is a safety function with high importance. Through the FHD camera, both a sensing value that senses a far distance of the front and a sensing value that senses a wide range of the front, although it is a short distance, through the ultrasonic sensor, the stability may be further improved.

Figure 8:
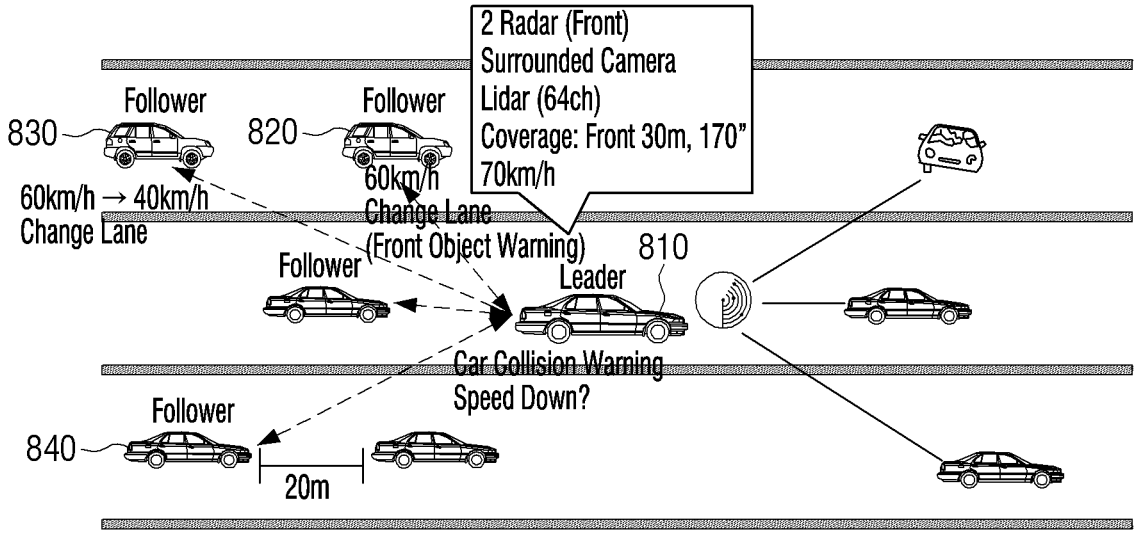
FIG. 8 is a diagram illustrating an example autonomous driving system according to an embodiment.

FIG. 8 is a diagram illustrating an example autonomous driving system according to an embodiment. According to the disclosure, although the plurality of vehicles may transmit/receive a server and information respectively, as described in FIG. 8, transmitting/receiving information between the plurality of vehicles in the group of vehicles through an AdHoc network.

For example, the plurality of vehicles in the group of vehicles may include a leader vehicle 810 and follower vehicles 820, 830, and 840 based on performance information of each car on a local network. In this case, operations of defining the leader vehicle 810 and the follower vehicles 820, 830, 840 may be performed by the server.

The leader vehicle 810 may identify surroundings based on sensing information that the leader vehicle senses by itself and sensing information received from the follower vehicles 820, 830 and 840, and transmit a driving control command to each of the follower vehicles 820, 830 and 840 based on the identified result. For example, when there is an accident vehicle is found, the leader vehicle 810 may warn that there is an object in front of a first follower vehicle 820 driving in a lane where the accident vehicle is located, and may command the vehicle to change lanes. Meanwhile, the leader vehicle may command a second follower vehicle 830 driving behind the first follower vehicle 820 to slow down and change lanes.

In addition, the leader vehicle 810 may transmit a driving control command to a third follower vehicle 840 based on sensing information obtained by the third follower vehicle 840. For example, when it is sensed that a distance from a vehicle ahead is 20 m by a third follower vehicle 840, and when the third follower vehicle 840 transmits it to the leader vehicle 810, the leader vehicle 810 may transmit the driving control command for lowering a speed, since there is a car collision warning with the vehicle ahead, to the third follower vehicle 840 based on a sensing value of the third follower vehicle 840.

As described above, the follower vehicles 820, 830, and 840 that receive the driving control command by the leader vehicle 810 may autonomously drive based on the received driving control command.

While it is described that the driving control command is generated and transmitted by the leader vehicle 810 in FIG. 8, it may be generated by the server when implementing in practice and transmitted to each vehicle. When transmitting the driving control command generated by the server to the leader vehicle 810, the leader vehicle 810 may transmit the driving control command to each follower vehicle 820, 830 and 840.

Figure 9:
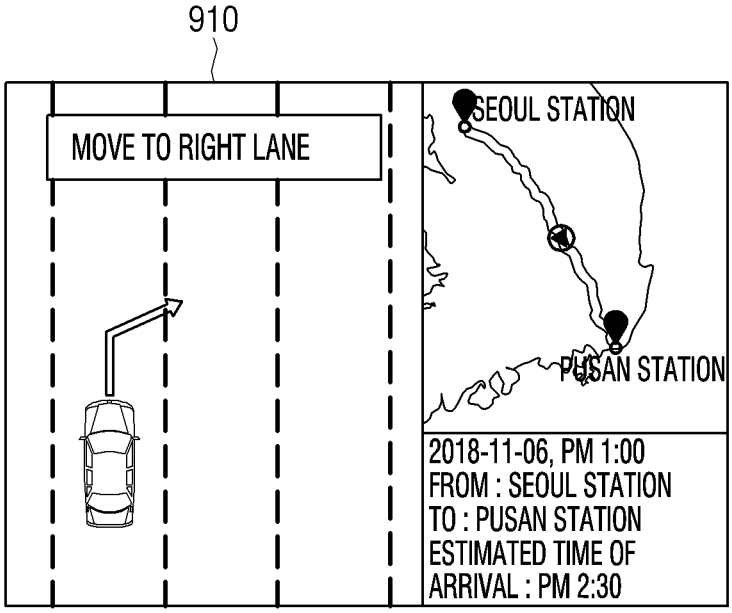
FIG. 9 is a diagram illustrating an example user interface (UI) provided to a user according to an embodiment.

When at least one of the follower vehicles 820, 830 and 840 is not supported by the autonomous driving function, a notification corresponding to the driving control command may be provided as a UI screen as shown in FIG. 9 and may be directly controlled by the user. At this time, the notification corresponding to the driving control command may be transmitted to each follower vehicles 820, 830, 840 by the server, or may be transmitted to the follower vehicles 820, 830, 840 by the leader vehicle 810.

According to the disclosure, FIG. 9 is a diagram illustrating an example user interface (UI) provided to a user according to an embodiment. For example, the UI screen as shown in FIG. 9 may be displayed by a navigation provided in an authenticated vehicle, a navigation connected to the authenticated vehicle, a terminal device of the user of the authenticated vehicle, or the like.

Referring to FIG. 9, the UI screen 910 may display a screen corresponding to a driving command. For example, if there is an accident vehicle or obstacle in front of a driving vehicle, the server may provide the vehicle with a UI that commands the vehicle to change a lane to the next lane. It may notify that there is an accident vehicle or an obstacle ahead with the driving command display. Optionally, driving information such as an entire driving path, a current vehicle position, and an estimated time of arrival may be displayed together.

Such UI screen may be provided to a vehicle which is not supported by the autonomous driving function, or may be provided to a vehicle capable of autonomous driving. A message "there is an accident vehicle ahead, change the lane to the right lane" may be displayed even when the vehicle is driven autonomously.

An embodiment in which the notification corresponding to the driving control command is displayed in the form of a UI is only illustrated in FIG. 9, but, when implementing in practice, the notification may be provided by a voice through a speaker provided in the vehicle and a speaker provided in a user terminal device corresponding to the vehicle.

Figure 10:
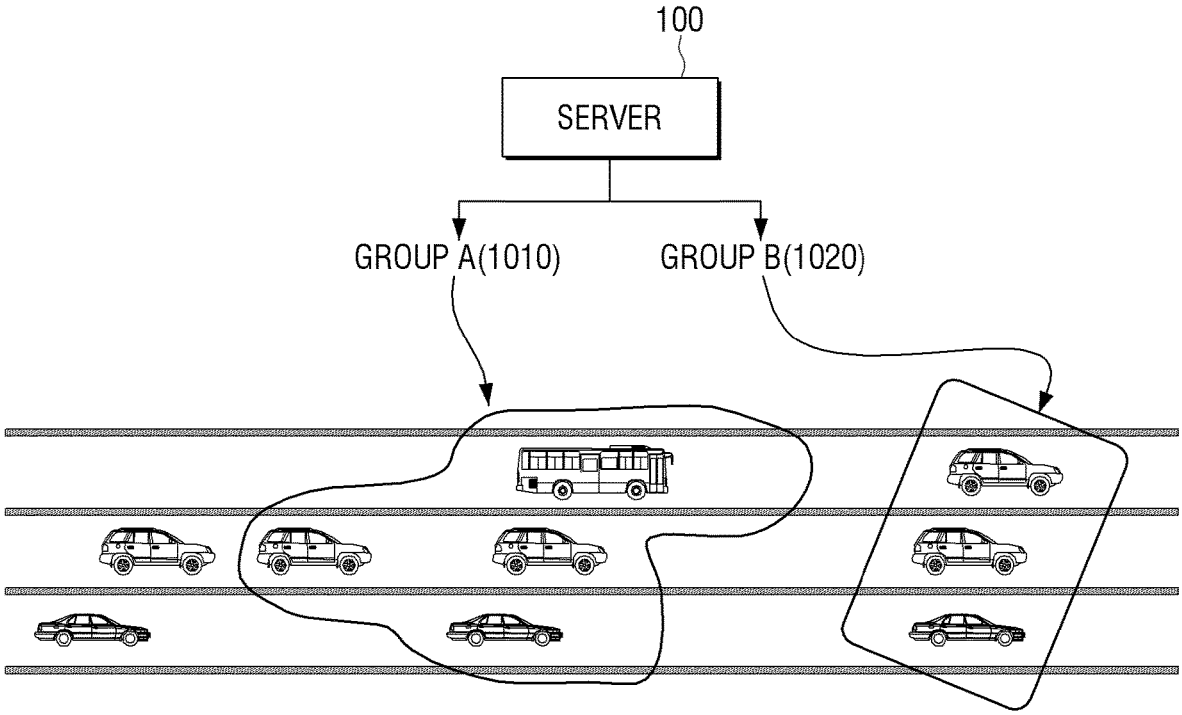
FIG. 10 is a diagram illustrating an example of performing a combination of safety components between groups according to an embodiment.

FIG. 10 is a diagram illustrating an example of performing a combination of safety components between groups according to an embodiment.

Referring to FIG. 10, the server 100 may generate a group A of vehicles 1010 including two or more vehicles based on a driving planning information, and drive in a state of securing a maximum safety or safety distance by assembling safety components of the vehicles included in the group A.

When another group B of vehicles 1020 is found around the group A 1010 in some driving sections, the server 100 may link the group A 1010 and the group B 1020. For example, the server 100 may recombine safety components of the group A 1010 and the group B 1020. At this time, the arrangement of the group A 1010 and group B 1020 may vary based on the recombined safety components.

When driving paths of the group A 1010 and the group B 1020 are different, the server 100 may recombine the safety components by each group.

As described above, an improved safety or safety distance may be secured by further considering safety components of other groups vehicles.

Figure 11:
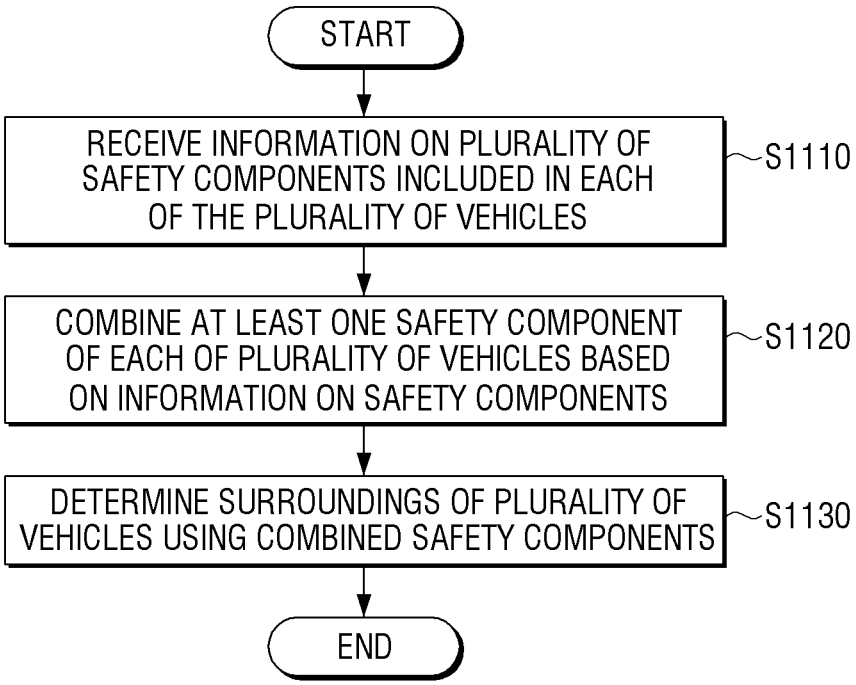
FIG. 11 is a flowchart illustrating an example method of controlling a server according to an embodiment.

FIG. 11 is a flowchart illustrating an example method of controlling a server according to an embodiment.

Referring to FIG. 11, the server may receive information on the plurality of safety components included in each of the plurality of vehicles, respectively (S1110). The information on the plurality of vehicles, respectively, may be received from the terminal devices or vehicles in which the user inputs information respectively. The information on the safety components of each vehicle may be directly input by the user or may be information predetermined by products of vehicles.

In addition, the server may combine at least one safety component of each of the plurality of vehicles, respectively, based on information on the safety components (S11120). Received safety components may be stored in the server, and the server may combine the safety components using stored information. The plurality of vehicles including the safety components to be combined may be vehicles in which at least some of driving paths match based on at least one of a departure point, a destination, a waypoint and a departure time.

The server may combine the safety components having the best performance for each function based on the information on the safety components provided in the plurality of vehicles, respectively. The server may identify an arrangement position of the plurality of vehicles based on the combination of safety components. The server may transmit information on the arrangement position to each vehicle to move over each vehicle to a corresponding position through an autonomous driving function, or may request the user to directly control the vehicle to move to the corresponding position.

In addition, the server may identify (determine) surroundings of the plurality of vehicles using the combined safety components (S1130). For example, the server may receive a sensing value obtained by the combined safety components, and identify the surroundings based on the received value.

In addition, the server may generate a driving control command of at least one of the plurality of vehicles based on a result of the sensing value of the surroundings of the plurality of vehicles, and transmit the generated driving control command to the at least one vehicle.

As described above, each vehicle may use not only the safety components provided in each vehicle but also the result of the sensing value of the surroundings obtained by a safety component of another vehicle, thereby improving safety or extending safety distances.

Various example embodiments described above may be embodied in a recording medium that may be read by a computer or a similar apparatus to the computer using software, hardware, or a combination thereof. According to the hardware embodiment, example embodiments that are described in the present disclosure may be embodied using, for example, and without limitation, at least one selected from application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, electrical units for performing other functions. In some cases, the embodiments described herein may be implemented as a processor itself. In a software configuration, various embodiments described in the disclosure such as a procedure and a function may be embodied as separate software modules. The software modules may respectively perform one or more functions and operations described in the present specification.

Methods of controlling a display apparatus according to various example embodiments may be stored on a non-transitory computer readable medium. The non-transitory computer readable medium may be installed and used in various devices.

The non-transitory computer readable recording medium may refer, for example, to a medium that stores data and that can be read by devices. For example, programs of performing the above-described various methods can be stored in a non-transitory computer readable medium such as a CD, a DVD, a hard disk, a Blu-ray disk, universal serial bus (USB), a memory card, ROM, or the like, and can be provided.

Methods according to various embodiments of the disclosure may be provided by including in a computer program product. The computer program product may be traded between sellers and buyers as a product. The computer program product may be distributed online in the form of a device-readable storage medium (e.g., a compact disc read only memory (CD-ROM)) or through an application store (e.g., Play Store™). In the case of online distribution, at least a portion of the computer program product may be stored at least temporarily or temporarily generated in the storage medium such as a server of a manufacturer, a server of an application store, or a memory of a relay server.

The foregoing example embodiments and advantages are merely examples and are not to intended to be limiting. The present disclosure may be readily applied to other types of apparatuses. The description of the example embodiments of the present disclosure is intended to be illustrative, and not to limit the scope of the claims, and many alternatives, modifications, and variations will be apparent to those skilled in the art.

What is claimed is:

1. A server, comprising:

a communicator comprising communication circuitry;

a memory; and a processor configured to control the server to:

obtain information on a plurality of safety components included in a plurality of vehicles, the information on the plurality of safety components including performance of the plurality of safety components, identify arrangement positions of the plurality of vehicles based on performance of the plurality of safety components, obtain a driving control command based on the identified arrangement positions of the plurality of vehicles, and transmit the obtained driving control command to at least one vehicle among the plurality of vehicles, wherein the processor is further configured to:

when a first vehicle includes a plurality of first safety components and each of the plurality of first safety components has best performance among the plurality of safety components, identify one of the plurality of first safety components based on a priority of safety functions corresponding to the plurality of first safety components, and identify arrangement position of the first vehicle based on the identified one of the plurality of first safety components.

2. The server as claimed in claim 1, wherein the plurality of vehicles at least partially coincide with each other on a driving path based on at least one of a departure point, a destination, a waypoint and a departure time.

3. The server as claimed in claim 2, wherein the processor is configured to control the server to: further obtain a driving speed based on at least one of the departure point, the destination, the waypoint and the departure time, and transmit a driving control command generated based on the driving path and the obtained driving speed to at least one autonomous driving vehicle among the plurality of vehicles through the communicator.

4. The server as claimed in claim 2, wherein the processor is configured to control the server to further obtain a driving speed based on at least one of the departure point, the destination, the waypoint and the departure time, and transmit a notification corresponding to a driving control command generated based on the driving path and the obtained driving speed to a user terminal corresponding to at least one of the plurality of vehicles through the communicator.

5. The server as claimed in claim 1, wherein the processor is configured to control the server to combine safety components having the best performance by function among the plurality of safety components included in the plurality of vehicles.

6. The server as claimed in claim 1, wherein the processor is configured to control the server to recombine safety components in consideration of at least one deleted vehicle or a safety component of a new vehicle based on at least one among the plurality of vehicles being deleted or a new vehicle being added.

7. The server as claimed in claim 1, wherein the processor is configured to, based on a vehicle including a safety component having higher performance than the combined safety components being searched around the plurality of vehicles while the plurality of vehicles are traveling, control the server to recombine the combined safety components based on the safety component of the searched vehicle.

8. The server as claimed in claim 1, wherein the processor is configured to control the server to recombine the safety components using the combined safety components and the combined safety components of an other group of vehicles based on the other group of vehicles existing around the plurality of vehicles while the plurality of vehicles are traveling.

9. The server as claimed in claim 1, wherein the plurality of vehicles are pre-authenticated.

10. A method of controlling a server, the method comprising:

obtaining information on a plurality of safety components included in a plurality of vehicles, the information on the plurality of safety components including performance of the plurality of safety components;

identifying arrangement positions of the plurality of vehicles based on performance of the plurality of safety components;

obtaining a driving control command based on the identified arrangement positions of the plurality of vehicles; and transmitting the obtained driving control command to at least one vehicle among the plurality of vehicles, wherein the identifying comprises:

when a first vehicle includes a plurality of first safety components and each of the plurality of first safety components has the best performance among the plurality of safety components, identifying one of the plurality of first safety components based on a priority of safety functions corresponding to the plurality of first safety components, and identifying arrangement position of the first vehicle based on the identified one of the plurality of first safety components.

11. The method as claimed in claim 10, wherein the plurality of vehicles at least partially coincide with each other on a driving path based on at least one of a departure point, a destination, a waypoint and a departure time.

12. The method as claimed in claim 11, further comprising:

obtaining a driving speed based on at least one of the departure point, the destination, the waypoint and the departure time; and transmitting a driving control command generated based on the driving path and the obtained driving speed to at least one autonomous driving vehicle among the plurality of vehicles.

13. The method as claimed in claim 11, further comprising:

obtaining a driving speed based on at least one of the departure point, the destination, the waypoint and the departure time; and transmitting a notification corresponding to a driving control command generated based on the driving path and the obtained driving speed to a user terminal corresponding to at least one of the plurality of vehicles.

14. The method as claimed in claim 10, wherein the combining comprises combining safety components having the best performance by function among the plurality of safety components included in the plurality of vehicles.

15. The method as claimed in claim 10, further comprising recombining safety components in consideration of a deleted at least one vehicle or safety components of a new vehicle based on at least one among the plurality of vehicles being deleted or a new vehicle being added.

16. The method as claimed in claim 10, further comprising, based on a vehicle including a safety component having higher performance than the combined safety components being searched around the plurality of vehicles while the plurality of vehicles are traveling, recombining the safety components based on the safety components of the searched vehicle.

17. The method as claimed in claim 10, further comprising recombining the safety components using the combined safety components and the combined safety components of another group of vehicles, based on the other group of vehicles existing around the plurality of vehicles while the plurality of vehicles are traveling.

18. A non-transitory computer readable recording medium comprising a program for executing a method of controlling a server, the method comprising:

obtaining information on a plurality of safety components included in a plurality of vehicles, the information on the plurality of safety components including performance of the plurality of safety components;

identifying arrangement positions of the plurality of vehicles based on performance of the plurality of safety components;

obtaining a driving control command based on the identified arrangement positions of the plurality of vehicles; and transmitting the obtained driving control command to at least one vehicle among the plurality of vehicles, wherein the identifying comprises:

when a first vehicle includes a plurality of first safety components and each of the plurality of first safety components has the best performance among the plurality of safety components, identifying one of the plurality of first safety components based on a priority of safety functions corresponding to the plurality of first safety components, and identifying arrangement position of the first vehicle based on the identified one of the plurality of first safety components.

* * * * *